United States Patent [19]

Hopfensperger et al.

[11] Patent Number: 4,973,825

[45] Date of Patent: Nov. 27, 1990

[54] CIRCULATION FAN FOR BAKING OVENS

[75] Inventors: Reinhold Hopfensperger, Dietelskirchen; Rolf Tungl, Ergolding, both of Fed. Rep. of Germany

[73] Assignee: Standard Elektrik Lorenz AG, Stuttgart, Fed. Rep. of Germany

[21] Appl. No.: 367,634

[22] Filed: Jun. 19, 1989

[30] Foreign Application Priority Data

Nov. 12, 1988 [DE] Fed. Rep. of Germany ..... 3838447

[51] Int. Cl.[5] ..... F27D 7/04

[52] U.S. Cl. ..... 219/400; 126/21 A

[58] Field of Search ..... 219/400, 10.55 D, 10.55 F, 219/10.55 R; 126/21 A

[56] References Cited

U.S. PATENT DOCUMENTS

| | | | |
|---|---|---|---|
| 4,053,730 | 10/1977 | Baron | 219/10.55 F |
| 4,211,909 | 7/1980 | Yoshida | 219/10.55 F |
| 4,303,817 | 12/1981 | Klement | 219/10.55 D |
| 4,308,417 | 12/1981 | Martin | 219/10.55 D |
| 4,335,290 | 6/1982 | Teich | 219/10.55 F |
| 4,358,653 | 11/1982 | Weiss | 219/10.55 F |
| 4,485,285 | 11/1984 | Machesney | 219/10.55 D |
| 4,687,908 | 8/1987 | Thorne | 219/400 |
| 4,764,651 | 8/1988 | Schwartz | 219/10.55 D |

*Primary Examiner*—Teresa J. Walberg
*Attorney, Agent, or Firm*—Spencer & Frank

[57] ABSTRACT

A circulation fan for circulating air in the baking muffle of an oven in which a conductive connection is made between the drive shaft and the back wall of the baking muffle whereby the RF energy passing outward over the surface of the drive shaft is short-circuited via the back wall of the baking muffle. The conductive connection is in the form of a spring element, e.g. a clamping member or a disk spring, whereby manufacturing and operational variations are compensated for. If the portion of the drive shaft located outside the baking muffle is roughened and/or covered with an electrically poorly conducting coating, further damping of the escaping RF energy is obtained.

12 Claims, 2 Drawing Sheets

CIRCULATION FAN FOR BAKING OVENS

BACKGROUND OF THE INVENTION

The present invention relates to a circulation fan for baking ovens, particularly for combined circulation and microwave ovens. In the case of combined circulation and microwave ovens, it must be insured that the radio frequency (RF) radiation in a baking muffle does not leak out. A particularly critical point where leakage should be prevented is not only the opening for the drive shaft in the back wall of the baking muffle, but also the drive shaft itself. To achieve a certain amount of leakage damping, the diameter of the opening should not exceed one quarter of a wavelength of the radio frequency. This condition can be met without major difficulty. To control the part of the radio frequency escaping via the drive shaft is much more difficult. If, for example, the length of the portion of the drive shaft protruding from the baking muffle is the wavelength lambda or one quarter, one half, five eighths, or a multiple of the wavelength lambda times a velocity factor, the drive shaft will act as a radiator (part of an antenna), with the back wall of the baking muffle used as a counterpoise. The velocity factor is a function of the material and the diameter of the drive shaft. Part of the energy radiated via the draft shaft is damped and converted into heat by the stator lamination of the drive motor and by the supporting members, but the free part can radiate unhindered. From German Pat. No. 31 18 463 it is known that a drive shaft made from ceramic material prevents the leakage of RF energy. This solution is very effective but also very expensive.

SUMMARY OF THE INVENTION

It is, therefore, the object of the invention to provide an effective and low-cost solution to the problem of how to prevent the radiation of RF energy via the drive shaft. This object is attained by a circulation fan having a baking muffle having a back wall, an electric motor flanged to the back wall of the baking muffle by means of a supporting member and a drive shaft extending through an opening in the back wall of the baking muffle into the baking muffle, wherein there is a conductive connection near the drive shaft between the drive shaft and the back wall of the baking muffle.

An advantage of the invention lies in the fact that a drive shaft of metal is still used. To damp the escaping RF energy, advantage is taken of the fact that, because of the high frequencies (order of about 2.5 GHz), a pronounced skin effect comes into play. This means that the electric energy leaves the baking muffle mainly via the surface of the drive shaft.

The RF energy escaping along the surface is received close to the shaft by an electrically conducting element, e.g. a clamping member, and short-circuited via the back wall of the baking muffle. This not only results in the shortest possible electrical path but also insures that manufacturing or operational variations (thermal expansion) are compensated for. Another advantage of the invention results if the portion of the drive shaft protruding from the baking muffle is roughened and/or provided with an electrically poorly conducting coating. Because of the above-mentioned skin effect, less RF energy escapes along a roughened surface than along a smooth one (lost-motion effect).

Embodiments of the invention will now be described in more detail with reference to the accompanying drawings,

DESCRIPTION OF THE PREFERRED EMBODIMENTS

Figure 1A:
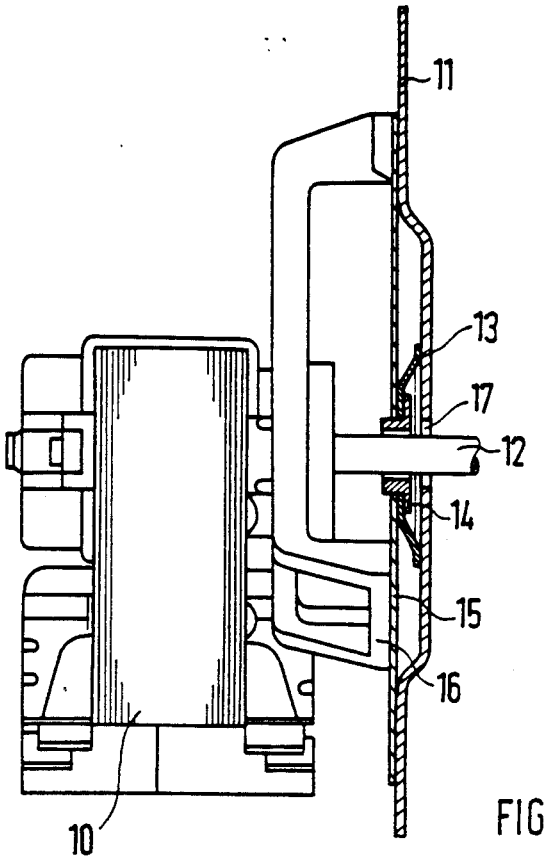
FIG. 1*a* shows a first embodiment of the invention.

In FIG. 1*a*, a drive motor 10 is flanged to a back wall 11 (shown only partly) of a baking muffle of an oven via a three-armed supporting member 16. A drive shaft 12 extends through an opening 17 into the interior of the baking muffle, where it drives a fan wheel (not shown). Between the back wall 11 of the baking muffle and the drive shaft 12, there is a conductive connection 13, which in this embodiment is a discos spring or clamping member. The clamping member 13 is attached to a bushing 14. Also provided is a shielding plate 15. The arrangement shown acts as follows: If RF energy leaks from the interior of the baking muffle via the drive shaft 12 extending through the opening 17, it will be short-circuited by a very short electrical path via the conductive connection 13, which is in this case a clamping member as mentioned above, and the back wall of the baking muffle. Since, due to the skin effect, the transport of RF energy from the interior of the baking muffle to the outside takes place essentially at the surface of the drive shaft, no RF energy can reach the supporting member or the motor. In the embodiment shown, the bushing 14 is held in place by the shielding plate 15. The purpose of the shielding plate 15 is to provide additional RF shielding. In the embodiment shown, the spring connection or spring element 13 is attached to the bushing 14. If another embodiment, the conductive connection 13 may be connected with the three-armed supporting member 16, i.e., no bushing is present. What is important is that the escaping RF energy is short-circuited by the shortest possible path via the back wall of the baking muffle, so that no electric energy can be radiated. By the use of a spring element as the conductive connection, manufacturing and operational variations are compensated for.

Figure 1B:
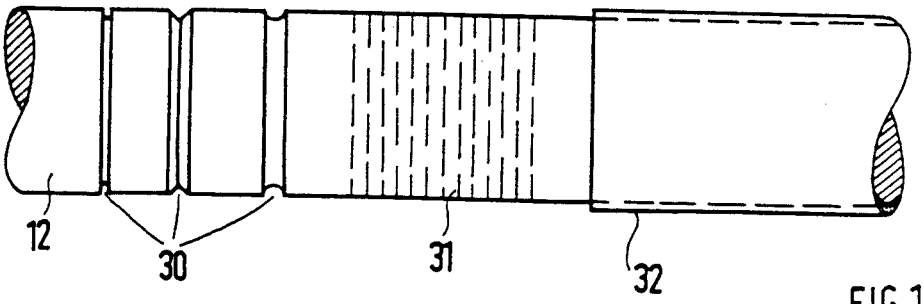
FIG. 1*b* shows the roughened surface of the drive shaft.

One possibility of minimizing the leaking part of RF energy is to roughen that portion of the drive shaft which lies outside the baking muffle, and/or to cover it with an electrically poorly conducting coating (reference numeral 32, FIG. 1*b*). Theses measures damp the transport of RF energy from the back wall (reduction of conductivity) and the radiation from the shaft portion outside the baking muffle (lost-motion effect). FIG. 1*b* shows a drive shaft provided with knurls 31 and grooves 30. A suitable coating is a graphite coating.

Figure 2:
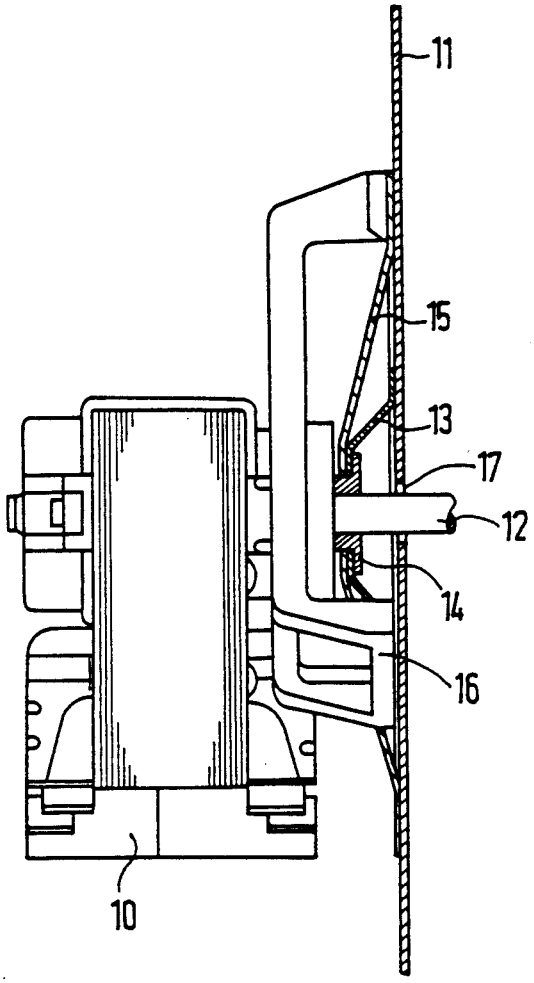
FIG. 2 shows a second embodiment of the invention.

FIG. 2 shows a second embodiment of the invention. Similar reference characters are used to designate parts having the same functions as in FIG. 1. In this embodiment, the bushing 14 supporting the spring element 13 is connected directly with the supporting member 16. The difference between the two embodiments follows from the different design of the back wall of the baking muffle.

We claim:

1. A circulation fan for circulating air in the baking muffle of an oven comprising:

a baking muffle having a back wall;

an electric motor flanged to said back wall of said baking muffle by means of a supporting member; and a drive shaft extending through an opening in said back wall of said baking muffle into said baking muffle, wherein there is a conductive connection between said drive shaft and said back wall of said baking muffle and wherein said conductive connection comprises a spring element.

2. A circulation fan as claimed in claim 1, wherein said spring element comprises a clamping member.

3. The circulation fan as claimed in claim 1, wherein there is a shielding plate conductively connected to said back wall of said baking muffle.

4. The circulation fan as claimed in claim 1, wherein said spring element comprises a disk spring.

5. The circulation fan as claimed in claim 1, further comprising a bushing which is freely movable along said drive shaft in an axial direction.

6. The circulation fan as claimed in claim 5, wherein said spring element is attached to said bushing.

7. The circulation fan as claimed in claim 1, wherein said spring element is attached to said supporting member.

8. The circulation fan as claimed in claim 2, wherein said drive shaft includes a portion located outside of said baking muffle which is roughened.

9. The circulation fan as claimed in claim 8, wherein said drive shaft includes a surface having knurls.

10. The circulation fan as claimed in claim 9, wherein said surface of said drive shaft is coated with a material of high electrical resistance.

11. A circulation fan as claimed in claim 8, wherein said drive shaft includes a surface having grooves.

12. A circulation fan as claimed in claim 8, wherein said drive shaft includes a surface having knurls and grooves.

* * * * *